United States Patent [19]

Berend

[11] 4,371,988

[45] Feb. 8, 1983

[54] GLOVES AND A METHOD OF MAKING THEREOF

[75] Inventor: Francis T. Berend, Boulogne-sur-Seine, France

[73] Assignee: Societe Anonyme Parinter, France

[21] Appl. No.: 196,293

[22] Filed: Oct. 14, 1980

Related U.S. Application Data

[60] Division of Ser. No. 78,661, Sep. 24, 1979, Pat. No. 4,272,568, which is a continuation of Ser. No. 844,465, Oct. 1, 1977, abandoned.

[30] Foreign Application Priority Data

Oct. 22, 1976 [FR] France ..... 76 31870

[51] Int. Cl.[3] ..... A41D 19/00

[52] U.S. Cl. ..... 2/167; 2/161 R

[58] Field of Search ..... 2/161 R, 167, 169, 163, 2/168

[56] References Cited

U.S. PATENT DOCUMENTS

| | | | |
|---|---|---|---|
| 2,060,961 | 11/1936 | Tillotson | 2/167 X |
| 2,873,450 | 2/1959 | Brodeur | 2/167 |
| 3,268,355 | 8/1966 | Brodeur | 2/167 X |
| 3,404,409 | 10/1968 | Tillotson | 2/161 |

FOREIGN PATENT DOCUMENTS

| | | | |
|---|---|---|---|
| 209349 | 2/1956 | Australia | 2/167 |

*Primary Examiner*—Richard J. Scanlan, Jr.

*Attorney, Agent, or Firm*—Robert E. Burns; Emmanuel J. Lobato; Bruce L. Adams

[57] ABSTRACT

A protective glove made of a fabric base or inner lining covered externally by a flexible, protective two-layer coating based on plasticized polyvinyl providing simultaneously high mechanical and physical strength and high resistance to chemical attack. The coating is made of two layers. A first inner is applied externally over the entire lining and has a high mechanical and physical strength. A second outer layer of the coating is bonded on the inner layer and has a high resistance to chemical attack. The outer layer covers entirely only the backsides and frontsides of the five fingers of the glove and the palm thereof constituting gripping areas used for gripping articles. The backside area of the glove is free of the outer layer of coating so that this area remains flexible for bending of the fingers and closing the hand. If the glove is provided with a wrist, it also is covered only with the first inner layer of the coating.

2 Claims, 3 Drawing Figures

GLOVES AND A METHOD OF MAKING THEREOF

Figure 1:
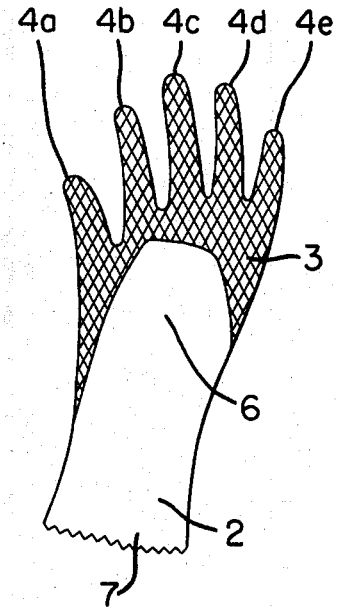

This is a division of application Ser. No. 078,661, filed Sept. 24, 1979, now Pat. No. 4,272,568, which is a continuation of application Ser. No. 844,465 filed Oct. 1, 1977 and now abandoned.

The invention relates to a protective glove and its method of manufacture.

Protective gloves are already known which are particularly intended for handling industrial castings (beams, blocks, tubes etc.) on the one hand and for protecting the user's hands against chemical products (acids, bases, grease, oils, solvents etc.) on the other hand. These gloves must thus withstand temporary physical or mechanical stresses (humidity, blunt objects, abrasive surfaces etc.) and permanent chemical stresses owing to the fact that certain chemical products such as oils and greases in particular, remain on the surface of the glove after it has been worn.

Protective gloves made from rubber or elastomer are known (French Pat. No. 2.256.730). However, the latter have a very limited use on account of the material used. Protective gloves are also known which have an inner lining of flexible fabric, for example interlock, completely covered externally by a film of plasticized polyvinyl chloride. This covering is produced in manner known per se by soaking, draining and gelling. Now, if the polyvinyl chloride is virtually insensitive to the action of chemical products, this is not true of the plasticizers. Consequently, the qualitative and quantitative composition of the plasticizer determines the qualities of mechanical and physical strength of the glove on the one hand and of chemical resistance on the other hand, which are related to each other. In fact, for example, such a plasticizer giving the glove very good qualities of chemical resistance, such as resistance to extraction by solvents, also gives the glove low flexibility, such that this glove is uncomfortable and awkward to use.

Thus, although this type of glove is satisfactory in theory, in practice its number of applications remains limited. This limitation of the number of applications has been shown particularly in British Pat. No. 880.166, U.S. Pat. No. 3,268,355, French Pat. No. 1.145.656 and Belgian Pat. No. 677.916. These patents intend either to modify the properties of the skin of the coating material, or to provide several layers covering each other completely, or to include local reinforcements in the protective coating, or to obviate a fault inherent in the inner coating layer by an additional coating layer. However, none of these patents intends to provide a glove which is fine and flexible throughout, simultaneously having excellent qualities of mechanical and physical strength and excellent qualities of chemical resistance. On the contrary, the patents cited propose solutions which are a compromise between the desire for fineness, flexibility, excellent qualities of mechanical and physical strength and excellent qualities of chemical resistance, which does not make it possible to produce satisfactory gloves.

The invention intends to obviate this drawback by proposing a glove comprising a flexible inner lining, for example of fabric, covered externally by a protective coating, in particular of plastics material based on plasticized polyvinyl chloride, characterised by the fact that said coating comprises, in combination, a first continuous inner layer applied to the entire lining and having excellent qualities of mechanical and physical strength on the one hand and a second outer layer having excellent qualities of chemical resistance on the other hand, covering the first inner layer partly at the point of the five fingers of the glove and the palm, whereas the back of the glove does not have the second outer layer such that the glove is both flexible overall, mechanically strong and protected from chemical attack in the gripping areas, in order that the first inner layer is not affected by the presence of chemical substances.

The invention also relates to a method of manufacture for a glove of this type, characterised by the fact that after having carried out a soaking operation in a first bath of material able to give the glove excellent qualities of mechanical and physical strength, after pre-gelling, which follows draining, one carries out a second soaking operation in a second bath of a coating material able to give the glove excellent qualities of chemical resistance, said second soaking being only partial and involving the fingers and palm of the glove.

Figure 2:
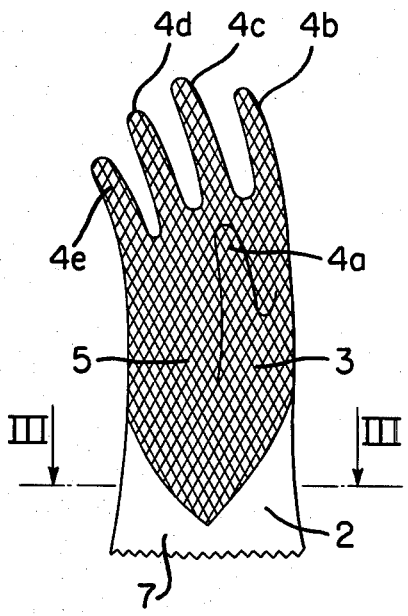

The invention will be better understood by means of the ensuing description referring to the accompanying drawings in which FIGS. 1 and 2 are two diagrammatic plan views of a preferred, but non-limiting embodiment of a protective glove according to the invention, showing respectively the back and palm of the glove.

Figure 3:
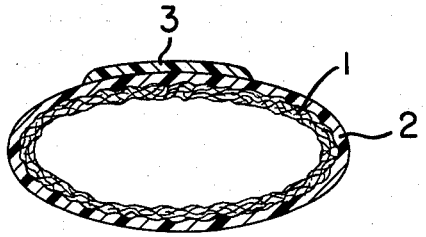

FIG. 3 is a diagrammatic sectional view on line III—III of FIG. 2.

A protective glove according to the invention, as illustrated in FIGS. 1 and 2, comprises a fine flexible inner lining 1 of fabric, for example such as interlock, covered externally by a fine continuous protective coating of plastics material which comprises, in combination, a first inner layer 2 applied to the lining 1 and having excellent qualities of mechanical and physical strength (with regard to humidity, blunt objects, abrasive surfaces etc.) and secondly a second outer layer 3 applied to the first inner layer 2 and having excellent qualities of chemical resistance (to acids, bases, greases, oils, solvents etc.). Thus, the first inner layer 2 gives the glove excellent qualities of mechanical and physical protection whereas simultaneously, the second outer layer gives the glove excellent qualities of chemical resistance and protects the first layer from chemical attack. The second outer layer 3 covers the first inner layer 2 only partly. More precisely, the five fingers 4*a*, 4*b*, 4*c*, 4*d*, 4*e* of the glove as well as the palm 5 are covered with the outer layer 3 whereas, on the contrary, the back 6 of the glove as well as the wrist 7 do not have this second outer layer 3 and thus have only the first inner layer 2. The purpose of a structure of this type is to considerably improve flexibility of the glove without however impairing its qualities of chemical resistance at the point of the areas of the first inner layer 2 serving for handling and which are thus likely to come into contact with chemical products.

The method of manufacture of a glove of this type is as follows: a mould covered with a lining is firstly soaked in a first mixture of polyvinyl chloride resin and plasticizer able to give the glove excellent qualities of mechanical and physical strength. The glove is firstly drained with the fingers pointing downwards, then with the fingers directed upwards. Pre-gelling of the first protective layer then takes place. The lining provided with the first layer is then subject to partial soaking in a mixture of polyvinyl chloride resin and plasticizer able to give the glove excellent qualities of chemical resistance. The gloves are drained firstly with the fingers pointing downwards, then with the fingers pointing upwards. Finally, gelling of the layers takes place for a period of time which is generally longer and at a temperature which is generally higher than those corresponding to pre-gelling.

As a non-limiting example, a first mixture of the following composition by weight has made it possible to produce a first layer having excellent qualities of mechanical and physical strength:

Polyvinyl Chloride: 100

Plasticizer (s): Approximately 110 to 130

Adjuvant (s): Approximately 2 to 10

The plasticizers may comprise phosphates able to impart high mechanical and physical strength, phthalates and polymers. For example, approximately 40 to 60 parts by weight phosphate for approximately 40 to 60 parts by weight phthalate and approximately 10 to 20 parts by weight polymer (adjuvants known per se: thickeners, colourants, stabilizers, fluidizers etc.).

On the other hand, a second mixture of the following composition by weight has made it possible to produce a second layer in combination with the first layer and giving the glove excellent qualities of chemical resistance:

Polyvinyl Chloride: 100

Plasticizer (s): Approximately 140 to 160

Adjuvant (s): Approximately 2 to 10

The plasticizers may comprise approximately 50 to 70 parts by weight phthalate, approximately 10 to 20 parts by weight phosphate and approximately 70 to 90 parts by weight polymer able to impart chemical resistance.

I claim:

1. A protective glove comprising, a flexible inner lining made of a fabric having externally thereon a flexible, protective two-layer coating based on plasticized polyvinyl, the coating being characterized by a first inner layer applied externally over the entire lining and having high mechanical and physical strength, a second outer layer bonded to the inner layer partly covering the inner layer and having a high resistance to chemical attack, the outer layer covering entirely only the backsides and frontsides of the five fingers of the glove and the palm thereof constituting gripping areas used for gripping articles, the backside of the glove being free of said outer layer, whereby the gripping areas simultaneously are flexible, have high mechanical and physical strength and are highly resistant to chemicals.

2. A protective glove according to claim 1, in which said lining has a wrist of the glove covered only by the first inner layer of said coating.

* * * * *